US005467894A

United States Patent [19]

Altonen et al.

[11] Patent Number: 5,467,894

[45] Date of Patent: Nov. 21, 1995

+

[54] INTERLEAVING DISPENSER FOR DISPENSING OBJECTS STACKED WITHIN A PACKAGE

[75] Inventors: Gene M. Altonen, West Chester; G. Scott Kerr, Mason, both of Ohio

[73] Assignee: The Proctor Gamble Company, Cincinnati, Ohio

[21] Appl. No.: 251,867

[22] Filed: Jun. 1, 1994

[51] Int. Cl.[6] ..... B65H 5/28; G07F 11/68

[52] U.S. Cl. ..... 221/71; 221/48; 221/70; 221/89; 221/312 C; 206/77.1; 206/499; 206/804

[58] Field of Search ..... 221/70, 71, 312 C, 221/305, 47, 48, 87, 89, 90; 206/77.1, 499, 804

[56] References Cited

U.S. PATENT DOCUMENTS

| | | | |
|---|---|---|---|
| Re. 34,193 | 3/1993 | Carey | 383/43 |
| 1,487,014 | 3/1924 | Davis | 206/499 |
| 1,651,289 | 11/1927 | O'Claire | 221/70 |
| 1,725,372 | 8/1929 | Richman . | |
| 2,177,999 | 10/1939 | Schwantes | 229/87.01 |
| 2,356,110 | 8/1944 | Waters | 206/46 |
| 2,637,439 | 5/1953 | Banks | 206/823 |
| 3,288,327 | 11/1966 | Cahlik | 221/70 |
| 3,384,226 | 5/1968 | Crisci | 206/65 |
| 3,395,852 | 8/1968 | Koncak | 229/87 |
| 3,399,762 | 9/1968 | Potter | 206/499 |
| 3,480,179 | 11/1969 | Rowland | 221/63 |
| 3,532,633 | 10/1970 | Withers | 252/90 |
| 3,568,911 | 3/1971 | Bebout | 221/305 X |
| 3,719,318 | 3/1973 | Moran | 229/58 |
| 3,730,421 | 5/1973 | Stanley | 229/66 R |
| 3,817,018 | 6/1974 | Vickers | 53/32 |
| 4,210,249 | 7/1980 | Holmes | 206/632 |
| 4,793,490 | 12/1988 | Evert | 206/497 |
| 4,997,105 | 3/1991 | Fischer | 221/305 X |
| 5,033,613 | 7/1991 | Liggett | 206/77.1 |
| 5,048,687 | 9/1991 | Suzuki et al. | 206/497 |
| 5,098,012 | 3/1992 | Will | 229/87.01 |
| 5,145,091 | 9/1992 | Meyers | 221/45 |

FOREIGN PATENT DOCUMENTS

| | | | |
|---|---|---|---|
| 593522 | 2/1934 | Germany | 221/70 X |
| 4037018 | 5/1992 | Germany . | |
| 1560631 | 2/1980 | United Kingdom . | |
| 2124597 | 2/1984 | United Kingdom . | |

*Primary Examiner*—William E. Terrell
*Assistant Examiner*—Dean A. Reichard
*Attorney, Agent, or Firm*—Michael E. Hilton

[57] ABSTRACT

In accordance with the present invention there is provided a dispensing package containing a plurality of objects. The objects are three-dimensional and have a pair of opposing faces connected by peripheral edges. The package includes a container having a top, a bottom and a body, all of which form an interior chamber containing the objects. The objects are stacked within the container in face to face relation, with the body of the container surrounding the peripheral edges of the objects. The stacked objects thereby define an uppermost object, adjacent to said top of the container, and a lowermost object, adjacent to the bottom of the container. The package further includes an interleaving dispenser. This dispenser is made from a bendable member having alternating horizontal and vertical panels connected to each other. The member is disposed within the package with the horizontal panels parallel to the top and bottom of the container. At least one horizontal panel is inserted between adjacent abutting objects along their faces, and one horizontal panel is inserted between the bottom of the container and the face of the lowermost object. The member further includes a handle, adjacent to the top of the container, for pulling the member away from the top so that the horizontal panels of the member are lifted towards the top, thereby dispensing the objects from the package.

16 Claims, 3 Drawing Sheets

INTERLEAVING DISPENSER FOR DISPENSING OBJECTS STACKED WITHIN A PACKAGE

FIELD OF THE INVENTION

The present invention relates to packages for containing multiple stacked objects such as soap bars. The present invention has further relation to a dispenser for such a package.

BACKGROUND OF THE INVENTION

In the past, bars of soap were typically sold individually by being packed in boxes, wrappers or the like. Recently, however, with the rise in popularity of club stores and the like, consumers have preferred to buy multiple bars of soap at once. Therefore, in order to market multiple bars of soap, manufacturers have typically packaged individual bars of soap in flexible paper-based wrappers having semi-rigid paperboard inserts. Thereafter, a number of these wrapped individual bars of soap would then be taped together. Other manufacturers package individual bars of soap in their own box and then wrap a number of these individual boxes together with thermoplastic film, tape or the like. However, this type of packaging was very wasteful in that each individual bar needed its own box or wrapper and on top of that the bundle itself needed additional packaging, such as wrappings, tape or the like in order to be sold as a single unit.

In order to overcome the above disadvantages there has been a desire to package a stack of soap bars in a single reclosable container or bag. Typically the soap bars are tightly constrained within the bag and stacked within the package in face-to-face fashion, with the faces of the soap bars being parallel to the reclosable top. However, with certain soap bar formulations, the individual bars will sometimes have a tendency to stick together. This makes retrieval of a single bar of soap from the bag difficult and this is further exasperated by the fact that many people retrieve a bar of soap after having been in the shower for a while. Moreover, many packages have the soap bars tightly packed within which also makes retrieval of a single bar difficult.

There has, therefore, been a need for a dispensing device for the abovedescribed type of package, which allows for easy dispensing of a single bar of soap and also prevents the bars from sticking together.

SUMMARY OF THE INVENTION

In accordance with the present invention there is provided a dispensing package containing a plurality of objects. The objects are three-dimensional and have a pair of opposing faces connected by peripheral edges. The package includes a container having a top, a bottom and a body, all of which form an interior chamber containing the objects. The objects are stacked within the container in face to face relation, with the body of the container surrounding the peripheral edges of the objects. The stacked objects thereby define an uppermost object, adjacent to said top of the container, and a lowermost object, adjacent to the bottom of the container. The package further includes an interleaving dispenser. This dispenser is made from a bendable member having alternating horizontal and vertical panels connected to each other. The member is disposed within the container with the horizontal panels parallel to the top and bottom of the container. At least one horizontal panel is inserted between adjacent abutting objects along their faces, and one horizontal panel is inserted between the bottom of the container and the face of the lowermost object. The member further includes a handle, adjacent to the top of the container, for pulling the member away from the top so that the horizontal panels of the member are lifted towards the top, thereby dispensing the objects from the package.

BRIEF DESCRIPTION OF THE DRAWINGS

While the specification concludes with claims particularly pointing out and distinctly claiming the subject invention, it is believed that the same will be understood from the following description taken in conjunction with the accompanying drawings in which:

DETAILED DESCRIPTION OF THE INVENTION

Figure 1:
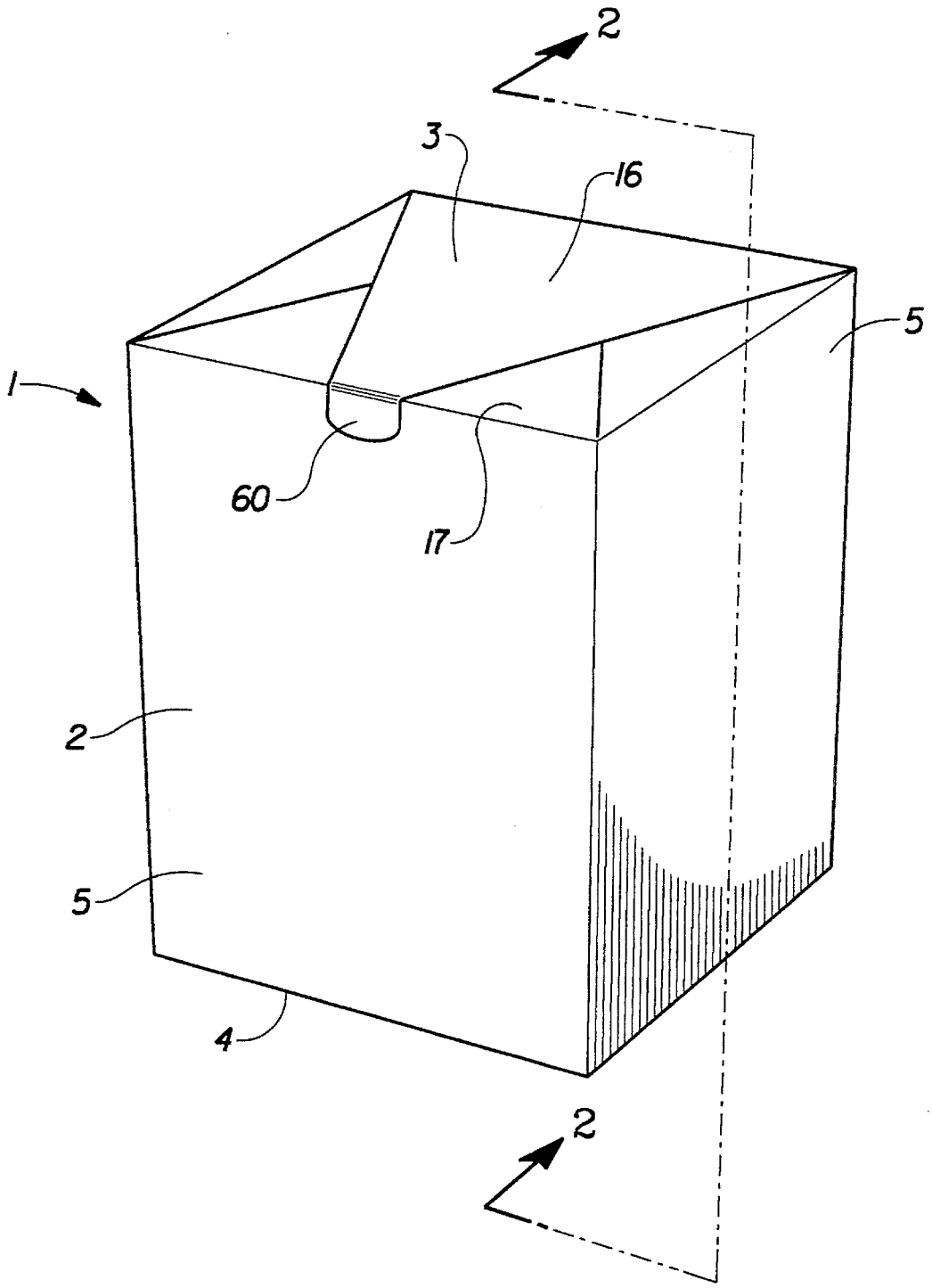
FIG. 1 is a perspective view of a package in accordance with the present invention.

Referring now to the drawings in detail wherein like numerals indicate the same element throughout the views, there is shown in FIG. 1 a perspective view of a package 1, in accordance with the present invention. Package 1 includes a container 2 having a top 3 a bottom 4 and body 5 all of which are joined together to form an interior chamber 6 (shown in FIG. 2) for containing a plurality of three-dimensional objects 50 such as soap bars. By referring to FIG. 3 one can see that objects 50 are three-dimensional and comprise a pair of substantially opposing faces 51 and 52 connected by peripheral edges 53. Objects 50 are shown in the Figures as being rectangular, however, they can take on any desired shape.

Figure 2:
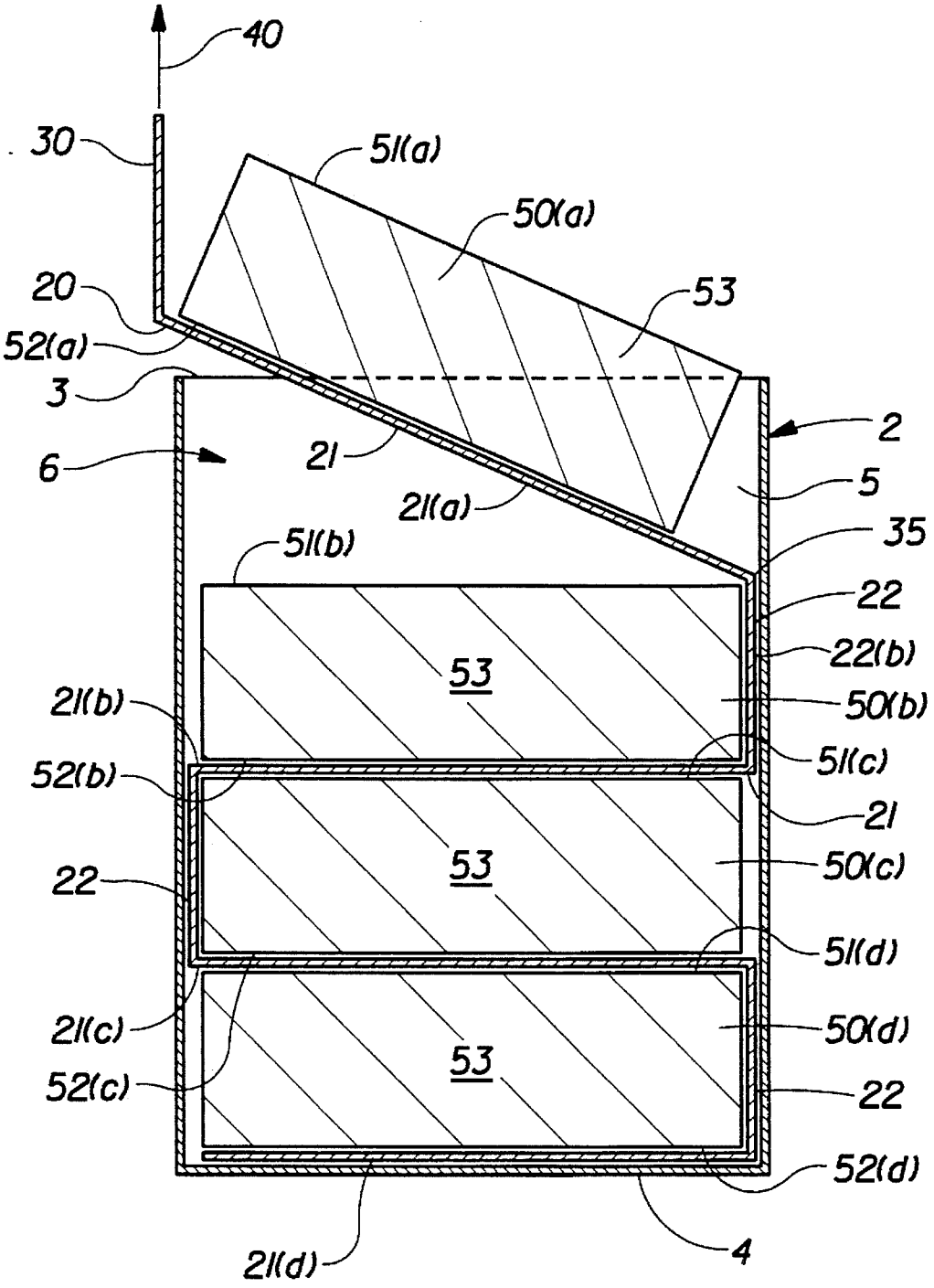
FIG. 2 is a side view of the package taken along line 2—2 in FIG. 1.
Figure 3:
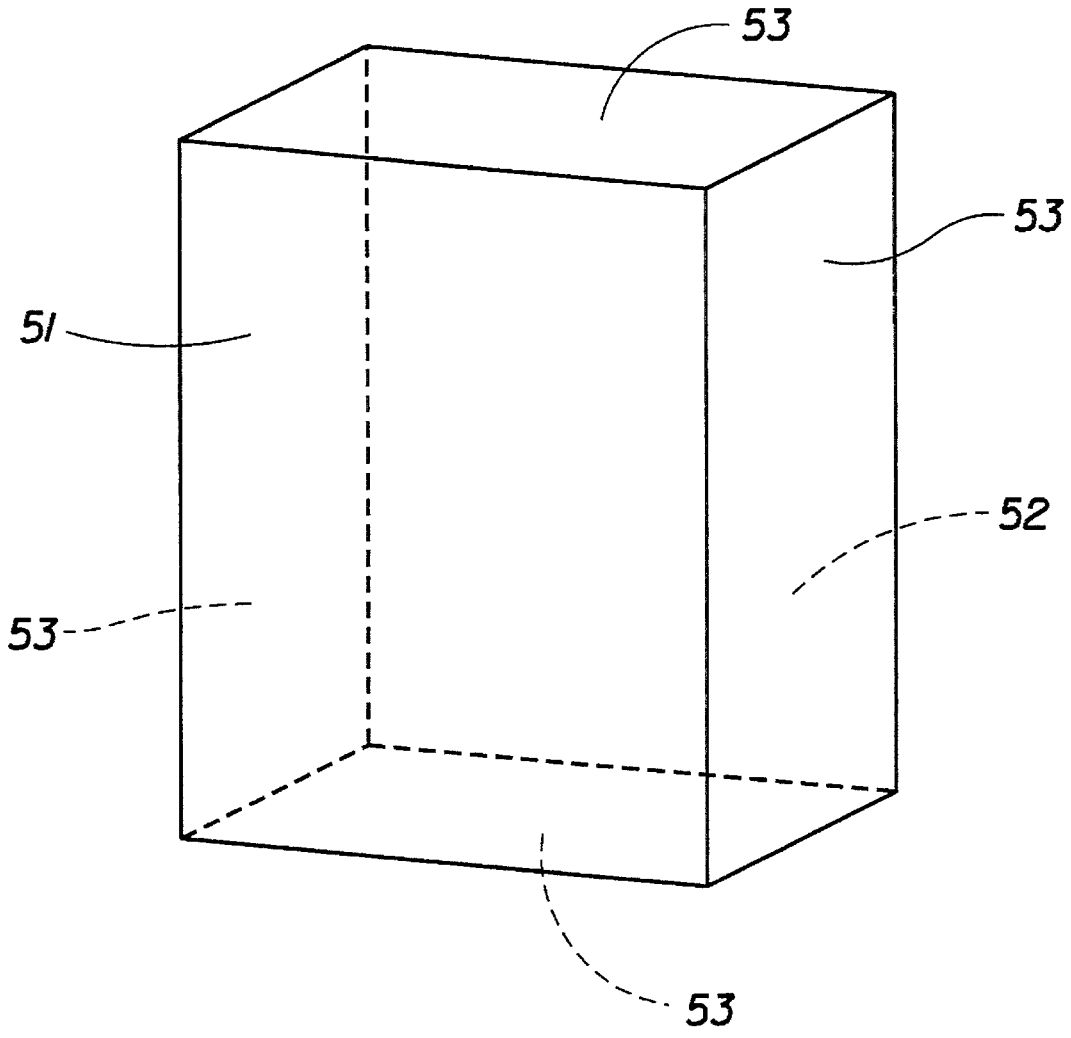
FIG. 3 is one embodiment of a three-dimensional object which can be contained in a package in accordance with the present invention.

The orientation of the objects within the package can best be described by referring to FIG. 2. FIG. 2 is a cross-sectional view of FIG. 1 taken along lines 2—2. As seen from FIG. 2 container 2 contains a plurality of three dimensional objects 50(*a*)–50(*d*). The objects are stacked within the container in thee to face relation with body 5 of container 2 surrounding the peripheral edges 53 of objects 50(*a*)–50(*d*). The stacked objects thereby define an uppermost object 50(a) adjacent to the top 3 of container 2, and a lowermost object 50(*d*) adjacent to the bottom 4 of container 2.

In accordance with the present invention package 1 further includes an interleaving dispenser 20 disposed within interior chamber 6 of container 2. Interleaving dispenser 20 is a bendable member made up of alternating horizontal panels 21 and vertical panels 22 connected to each other. Horizontal panels 21 are substantially parallel to the top 3 and bottom 4 of container 2. At least one horizontal panel is inserted between adjacent abutting objects between their faces. For example horizontal panel 21(*a*) is between the abutting faces 52(*a*) and 51(*b*) of objects 50(*a*) and 50(*b*) respectively, horizontal panel 21(*b*) is inserted between the abutting faces 52(*b*) and 51(*c*) of objects 50(*b*) and 50(*c*) respectively, and horizontal panel 21(*c*) is inserted between the abutting faces 52(*c*) and 51(*d*) of objects 50(*c*) and 50(*d*) respectively. Furthermore, at least one horizontal panel 21(*d*) is inserted between the bottom 4 of container 2 and face 52(*d*) of lowermost object 50(*d*).

The dispenser 20 can be made from any number of materials known in the art including a semi-rigid material such as ten point thick cartonboard. Semi-rigid materials can be scored along the intersection of the horizontal and vertical panels to facilitate bending so the dispenser can properly interleave. Alternatively, the dispenser can be made from a flexible material such as 2 mil thick polymer film. Those skilled in the art will recognize any number of suitable materials for making the dispenser such as coated paperboard, semi-rigid and flexible polymers, metals, paper and coated paper etc.

Interleaving dispenser 20 further includes a means or a handle, adjacent top 3 of container 2, for pulling dispenser 20 away from the top 3 of container 2. In the embodiment shown in FIG. 2 the means or handle comprises a pull tab 30. As seen from FIG. 2 when pull tab 30 is pulled away from top 3 in the direction of arrow 40, object 50(*a*) is lifted out of the package in a manner which makes it easier for a consumer to grab it. In a preferred embodiment alternating horizontal panels 21 and vertical panels 22 are connected to each other by way of a line of weakness such as perforations 35. Thereafter after each object is removed, such as soap bar 50(*a*), the horizontal panel beneath that object, panel 21(*a*), is removed from its adjacent vertical panel, panel 22(*b*), and that vertical panel, panel 22(*b*), acts as the pull tab for the next object, object 50(*b*).

Suitable materials for forming container 2 include paper, cartonboard, semi-rigid polymers and polymer laminates, paper and polymer co-extruded materials, paper with paraffin/hot melt coatings and any other suitable material known in the art. Preferably, the material has enough memory to form a container which is substantially rectangular or the dispenser gives the container 2 a rectangular shape. This gives the package more stability when stacked on a store shelf or the like when they are stacked on top of one another. Moreover, it is preferred that the material have the necessary barrier properties in order to protect its contents. For bar soap the material needs sufficient air and moisture barrier to prevent fragrance and moisture loss before opening.

In a preferred embodiment the package further includes a reclosure device so that the container can be securely reclosed each time after it has been opened. FIG. 1 shows the reclosure device as a tab 60 extending from closure flap 16 which forms part of the top 3 of container 2. Tab 60 has a low strength adhesive on its inner face which makes contact with the container 2. After the package has been opened, by separating closure flaps 16 and 17, a consumer can gain access to the interior chamber 6 and retrieve an object 50 through the use of the dispenser 20. Thereafter, the top 3 of the container 2 can be rolled or folded down to the next available bar in such a way that closure flap 16 covers the folded down portion of top 3 so that the tab 60 can be resecured to the body 5, thereby reclosing the package. As will be appreciated by those skilled in the art, any number of reclosure devices can be used such as twist ties, tin ties, mechanical closures such as Velcro®, resealable adhesives, resealable tapes, self adhering co-adhesives and the like. Alternatively, the container 2 can be made from a material having sufficient dead fold properties that the package can be reclosed, after removal of an object, by folding the container. In one alternative embodiment the handle could be integral with the opening tab 60 or with any of the closure flaps.

Preferably, if the container is made from a flexible material the objects 50 are packed within the container 2 in such a way that movement of the objects with respect to the container 2 and with respect to each other is substantially limited or prevented, i.e. The objects are tightly packed within the container. This allows the objects to be stacked on top of one another while substantially preventing an object from one package to enter the space between the objects of a package below it, thereby causing the stack to become unstable and possibly tearing the package material. That is shingling is substantially prevented. The preferred maximum distance between objects 50 and the top or bottom wall respectively is preferably less than ¼ in. (0.635 cm.). Moreover, if the objects were perfectly centered within the container the objects would preferably have a maximum clearance between the object and the body 5 of less than ⅛ of an inch. The maximum clearances given above are preferred but not required and are based on the balance between the clearance needed for insertion of the objects within the package and the clearance needed to facilitate removal of the product.

Because the objects are preferably tightly packed within the container and because the package preferably has a substantially rectangular shape, the package is able to stand on a store shelf or the like with the objects resting on their peripheral edges. This is the preferred orientation for placing the packages on a shelf, so that shelf space is utilized efficiently. Moreover, the placing of the objects 50 within the rectangular package 1 allows multiple packages to be stacked on top one another in a warehouse or the like. The tight fit of the bars within the package prevents shingling of adjacent bars, which could rip or tear the package. Allowing the bars to carry the load permits the objects to be shipped and stored in less expensive shipping containers, which do not have to carry the load, or no shipping container at all.

The package can be formed in any number of ways known in the art including having the package material roll stock fed from a reel, wrapping it around a vertical mandrel, cutting and folding it to the proper shape and then filling it. It should be noted that the present invention requires one less operation and hence one less single operation machine. In the prior art manufacturing processes three operations were needed: one to form the boxes for containing individual soap bars, one to fill the boxes, and one to wrap multiple boxes together. In the present invention only two operations are needed: one to make the package and one to fill the package. Therefore, the present invention lends itself to a more efficient and inexpensive manufacturing method.

While particular embodiments of the present invention have been illustrated and described herein, various modifications may be apparent to those skilled in the art without departing from the spirit and scope of the present invention. Accordingly, the scope of the present invention should be considered in terms of the following claims and is understood not to be limited to the details described and shown in the specification and drawings.

What is claimed is:

1. A dispensing package containing a plurality of objects, said objects being three-dimensional having a pair of substantially opposing faces connected by peripheral edges, said package comprising:

(a) a container comprising a top, a bottom and a body joined to said top and said bottom so as to form an interior chamber containing said objects, said objects being stacked within the container in face to face relation, with said body surrounding said peripheral edges of said objects, said stacked objects thereby defining an uppermost object adjacent to said top of said container and a lowermost object adjacent to said bottom of said container; and (b) an interleaving dispenser comprising a bendable member having alternating horizontal and vertical panels connected to each other along lines of weakness, said member being disposed within said package with said horizontal panels substantially parallel to said top and bottom of said container, one of said horizontal panels being inserted between each adjacent set of abutting objects along their faces and one horizontal panel being inserted between said bottom of said container and a face of said lowermost object adjacent to said bottom of said container, said member further including a means, adjacent said top of said container, for pulling said member away from said top of said container such that said horizontal panels of said member are lifted towards said top, thereby dispensing said objects from said package.

2. The package of claim 1 wherein said means, adjacent said top of said container, for pulling said member away from said top of said container such that said horizontal panels of said members are lifted towards said top comprises a pull tab connected to a horizontal panel adjacent said uppermost object.

3. The package of claim 1 wherein said dispenser is made from paperboard.

4. The package according to claim 1 wherein said container further includes an integral reclosure device.

5. The package according to claim 4 wherein said integral reclosure device comprises a tab extending from said top of said container, said tab having an adhesive disposed thereon for attaching to said body of said container after said package is opened.

6. The package according to claim 1 wherein said container is made from a material having sufficient dead fold properties that said package can be reclosed through folding said container after removal of an object.

7. The package according to claim 1 wherein said container is made from a laminated paper material.

8. The package according to claim 1 wherein said three dimensional objects are soap bars.

9. A dispensing package containing a plurality of objects, said objects being three-dimensional having a pair of substantially opposing faces connected by peripheral edges, said package comprising:

(a) a container comprising a top, a bottom and a body joined to said top and said bottom so as to form an interior chamber containing said objects, said objects being stacked within the container in face to face relation, with said body surrounding said peripheral edges of said objects, said stacked objects thereby defining an uppermost object adjacent to said top of said container and a lowermost object adjacent to said bottom of said container; and (b) an interleaving dispenser comprising a bendable member having alternating horizontal and vertical panels connected to each other along lines of perforation, said member being disposed within said package with said horizontal panels substantially parallel to said top and bottom of said container, one of said horizontal panels being inserted between each adjacent set of abutting objects along their faces and one horizontal panel being inserted between said bottom of said container and a face of said lowermost object adjacent to said bottom of said container, said member further including a handle, adjacent said top of said container, for pulling said member away from said top of said container such that said horizontal panels of said member are lifted towards said top, thereby dispensing said objects from said package.

10. The package of claim 9 wherein said handle, adjacent said top of said container, for pulling said member away from said top of said container such that said horizontal panels of said member are lifted towards said top comprises a pull tab connected to a horizontal panel adjacent said uppermost object.

11. The package of claim 9 wherein said dispenser is made from paperboard.

12. The package according to claim 9 wherein said container further includes an integral reclosure device.

13. The package according to claim 12 wherein said integral reclosure device comprises a tab extending from said top of said container, said tab having an adhesive disposed thereon for attaching to said body of said container after said package is opened.

14. The package according to claim 9 wherein said container is made from a material having sufficient dead fold properties that said package can be reclosed through folding said container after removal of an object.

15. The package according to claim 9 wherein said container is made from a laminated paper material.

16. The package according to claim 9 wherein said three dimensional objects are soap bars.

* * * * *